US006805598B2

(12) United States Patent
Goldbach

(10) Patent No.: US 6,805,598 B2
(45) Date of Patent: Oct. 19, 2004

(54) LIQUID NATURAL GAS TRANSFER STATION

(75) Inventor: Robert D. Goldbach, Milford, PA (US)

(73) Assignee: Dorob International Ltd., Milford, PA (US)

( * ) Notice: Subject to any disclaimer, the term of this patent is extended or adjusted under 35 U.S.C. 154(b) by 0 days.

(21) Appl. No.: 10/652,659

(22) Filed: Aug. 28, 2003

(65) Prior Publication Data

US 2004/0045490 A1 Mar. 11, 2004

Related U.S. Application Data

(60) Provisional application No. 60/408,695, filed on Sep. 6, 2002.

(51) Int. Cl.[7] ..... B63B 22/02
(52) U.S. Cl. ..... 441/4; 114/74 R; 114/74 T
(58) Field of Search ..... 114/44–49, 74 R, 114/74 T, 230.1

(56) References Cited

U.S. PATENT DOCUMENTS 3,556,170 A * 1/1971 Bily ..... 141/1
3,674,042 A * 7/1972 Deal et al. ..... 137/1
4,786,210 A * 11/1988 Williams ..... 405/217
5,215,024 A * 6/1993 McAllister ..... 114/45
6,546,739 B2 * 4/2003 Frimm et al. ..... 62/50.2

* cited by examiner

*Primary Examiner*—Ed Swinehart
(74) *Attorney, Agent, or Firm*—Fish & Richardson P.C.

(57) ABSTRACT

A semi-submersible floating transfer station for unloading liquid natural gas (LNG) from, or charging LNG to an oceangoing vessel. The station comprises at least one and preferably two or more pontoons that include outboard sections comprising LNG tanks and a depressed center section, said sections forming a U-shaped channel into which an oceangoing vessel may enter for discharging or loading. The station includes pumping and piping means for transferring LNG and ballast-deballast system for accommodating the depth of the center section to the draft of the vessel as it is unloaded or charged. Pontoon can be uncoupled for individual transport to a drydock.

9 Claims, 4 Drawing Sheets

LIQUID NATURAL GAS TRANSFER STATION

Under 35 USC §119(e)(1), this application claims the benefit of prior U.S. provisional application 60/408,695, filed Sep. 6, 2002.

TECHNICAL FIELD

This invention relates to the loading and unloading of ocean-going vessels transporting liquefied natural gas (LNG).

BACKGROUND

Natural gas is a highly desirable fuel for domestic and industrial use because of the environmental advantage of its clean burning. The internal availability of natural gas resources frequently falls far short of demand in larger developed and developing industrial countries, while certain less developed countries have reserves of natural gas which far exceeds their internal requirements. This situation has created a significant demand for ocean shipment of natural gas from countries with excess reserves to countries with excess demand, particularly when these countries have access to deep water port facilities.

In order for natural gas to be economically shipped in oceangoing vessels, it typically needs to be liquefied from its naturally occurring gaseous state by refrigeration to a temperature at or near its atmospheric boiling point of approximately minus 260° F. (minus 160° C.). Such liquefied natural gas is commonly referred to as "LNG". Liquifaction and storage facilities for LNG are traditionally land-based and near to a deep water loading port from which the LNG may be exported. In a similar way receiving facilities for LNG typically include land-based LNG storage and regasification facilities installed near to a deep water receiving port. LNG receiving facilities typically regasify the LNG on site in order that the resulting natural gas may be distributed or utilized directly as a gaseous fuel. Over time the use of such land-based facilities has become increasingly problematical for reasons relating to public safety and cost, and potential use of floating offshore facilities for serving some or all of these functions has received increased attention. Floating facilities for the transfer, storage, liquifaction and/or regasification of LNG present significant design, construction and operating challenges. Some of these challenges, such as LNG containment and piping and pumping systems, are comparable to those of oceangoing LNG vessels and can be resolved utilizing available technologies. Similarly, liquifaction and regasification equipment installed on floating facilities is comparable to that used in land-based facilities, and a floating facility primarily needs to assure that appropriate space is provided for such equipment.

However, the safe open seas transfer of LNG between oceangoing vessels and floating storage facilities presents a unique challenge. Wind and waves can create severe irregular relative motions while the two are moored to each other, and such motions can impede or even prevent the safe transfer of LNG.

Furthermore, a floating LNG storage facility by definition must provide for transfer of either LNG or natural gas (in the case of liquifaction or regasification capability on board the floating facility) to or from land-based storage and piping systems.

Finally compared to shore-based facilities, floating facilities entail a further requirement for ongoing underwater maintenance, including periodic dry docking. The present invention addresses these unique requirements in a highly economical manner and furthermore accommodates installation of a variety of LNG tank containment and pumping systems traditionally installed on oceangoing LNG vessels.

An aspect of this invention is a floating transfer facility for safe transfer of LNG to or from an LNG ship or other ocean-going vessel, such as a barge.

Another aspect of this invention is a floating transfer facility for the safe transfer of LNG or natural gas to or from a land-based piping system.

Another aspect of this invention is the installation of insulated LNG tanks for the temporary storage of LNG.

Another aspect of this invention is a modular floating transfer facility which can continue in operation during the temporary removal of one of its modules for maintenance and repair.

Another aspect of this invention is a modular floating transfer facility which can carry out below-waterline maintenance and repair of at least one module by temporarily removing it, placing it in a well formed by the remaining modules, and lifting it clear of the water for maintenance and repair.

SUMMARY

The invention is a semi-submersible floating LNG transfer facility which has some or all of the following capabilities: to (1) load or discharge oceangoing LNG tank vessels; (2) retain LNG on board the facility within specially built and insulated LNG storage tanks; (3) transfer LNG from a ship to on-board tanks, from on-board tanks to a ship, from a ship directly to underwater piping systems connecting to shore-side tanks, and/or from shore side piping systems to a ship; (4) when fitted with liquifaction equipment to receive natural gas from shore, liquefy it into LNG and either transfer the LNG directly into an oceangoing LNG tank vessel or into onboard LNG storage tanks; and (5) when fitted with regasification equipment to regasify LNG from either an oceangoing LNG tank vessel or on-board LNG storage tanks and transfer the resultant natural gas to shore through underwater piping systems.

The invention is a transfer station that includes one or more similar U-shaped semi-submersible structures, typically of steel, that we refer to as "pontoons". In embodiments containing multiple pontoons, the transfer station is modular, and pontoons can be reversibly interlocked one to another to create an LNG transfer station structure. The station is submersible by addition of water ballast until it achieves sufficient sinkage to allow entry of an oceangoing LNG vessel into the center area of the interlocked U-shaped pontoon or pontoons, where pontoon sidewalls provide shelter from waves and wind. The structure of the invention can then be raised by deballasting to bring it into contact or near contact with the bottom of the LNG vessel without the need to assume any significant weight of said vessel. Embodiments of the invention may also includes mooring means to temporarily moor the vessel to the invention at approximately the level of the vessel's upper deck. The combination of this contact between vessel and transfer station structure with physical shelter from wind and seas provided to the vessel by side walls of the invention and temporary mooring and fendering arrangements provided between the vessel and transfer station at approximately the level of the vessel's upper deck acts to minimize relative motion between vessel and transfer station. Said minimization of relative motion serves to ensure a safe connection between piping systems on the LNG vessel and the transfer station, thereby facilitating safe transfer of LNG either from LNG vessel tanks to transfer station or tanks located therein, or vice versa.

Each pontoon of the transfer station is equipped with a ballast/deballast system, preferably a rapid-response system, to maintain the desired contact between transfer station structure and bottom of the LNG vessel as the weight of LNG is transferred from LNG vessel to transfer station and vice versa. Said ballast/deballast system may also include a passive stabilization feature, which reduces wind and wave induced motions by the transfer station. Said passive stabilization feature interconnects ballast tanks on both sides of the pontoon in a manner which acts to transfer ballast from side to side in opposition to wave action.

In addition to temporarily interlocked similar U-shaped pontoons, the transfer station may be fitted with a dissimilar bow pontoon or section temporarily or permanently interlocked to the forwardmost U-shaped pontoon and connected at its forwardmost point to a mooring system anchored to the sea bottom. The bow section would typically have no U-shaped center well, be the same width and extreme depth at its after end as the U-shaped pontoon to which it is attached, be rounded or pointed at its forward end, and serve the functions of improving the transfer station's hydrodynamic performance while closing and sheltering the U-shaped well of the transfer station in the normal bow sea situation. Said bow section may also be equipped with personnel accommodation and work spaces; liquifaction or regasification systems; machinery needed to generate electricity or other power required by the LNG transfer station to perform its various functions; and other equipment associated with the on-board storage of LNG, the mooring of LNG vessels within the LNG transfer station, the preferable single point mooring of the LNG transfer station to the ocean bottom, the transfer of LNG between LNG vessel and LNG transfer station, and the transfer of LNG or natural gas between the transfer station and shoreside facilities.

Whether its LNG tanks are empty, full or partially full, each pontoon has the capability to be submerged by addition of water ballast to a water depth of its U-shaped well deeper than the extreme draft of the oceangoing LNG vessels for which the LNG transfer station is intended, and when so submerged said pontoon will have adequate reserve buoyancy to survive normally anticipated sea conditions.

Each U-shaped pontoon may be fitted with two or more LNG storage tanks, a self-contained ballast/deballast system optionally including passive roll stabilization features, and piping and pumping system associated with the transfer and containment of L NG which can be interconnected to comparable piping and pumping systems installed on other pontoons. At least one of the pontoons is further equipped with a means of connecting the interconnected transfer station LNG piping and pumping system with the LNG piping and pumping system of the oceangoing LNG vessel. At least one of the pontoons is further equipped with a land-based piping system for LNG, natural gas, or both.

The physical dimensions of the invention are sufficient for it to (1) serve as transfer station for oceangoing vessels of a size traditionally used for the transportation of LNG (2) contain within its LNG tanks at least all or part of the LNG anticipated to be transferred to it from an oceangoing vessel, (3) contain within its ballast tanks sufficient sea water capacity to submerge its U-shaped well to a water depth which exceeds the extreme draft of traditional oceangoing LNG vessels, and (4) have sufficient reserve buoyancy during any operating condition to ensure safe operation and survive normally anticipated sea conditions.

As indicated, the transfer station according to his invention may be of modular construction comprising multiple pontoons. The pontoons may be dimensioned so as to be associated with the nearest dry-dock, where individual pontoons may be towed for repair. Alternatively or in addition the pontoons may be dimensioned such that the transfer station itself can serve as a floating dry-dock. For this purpose the fore/aft pontoon length is dimensioned such that an individual pontoon can be removed from the assembly, deballasted, turned ninety degrees and inserted into the U-shaped well of the remaining pontoons, where it can be hoisted free of the water or raised free of the water by deballasting the remaining interlocked pontoons for underside repair work.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
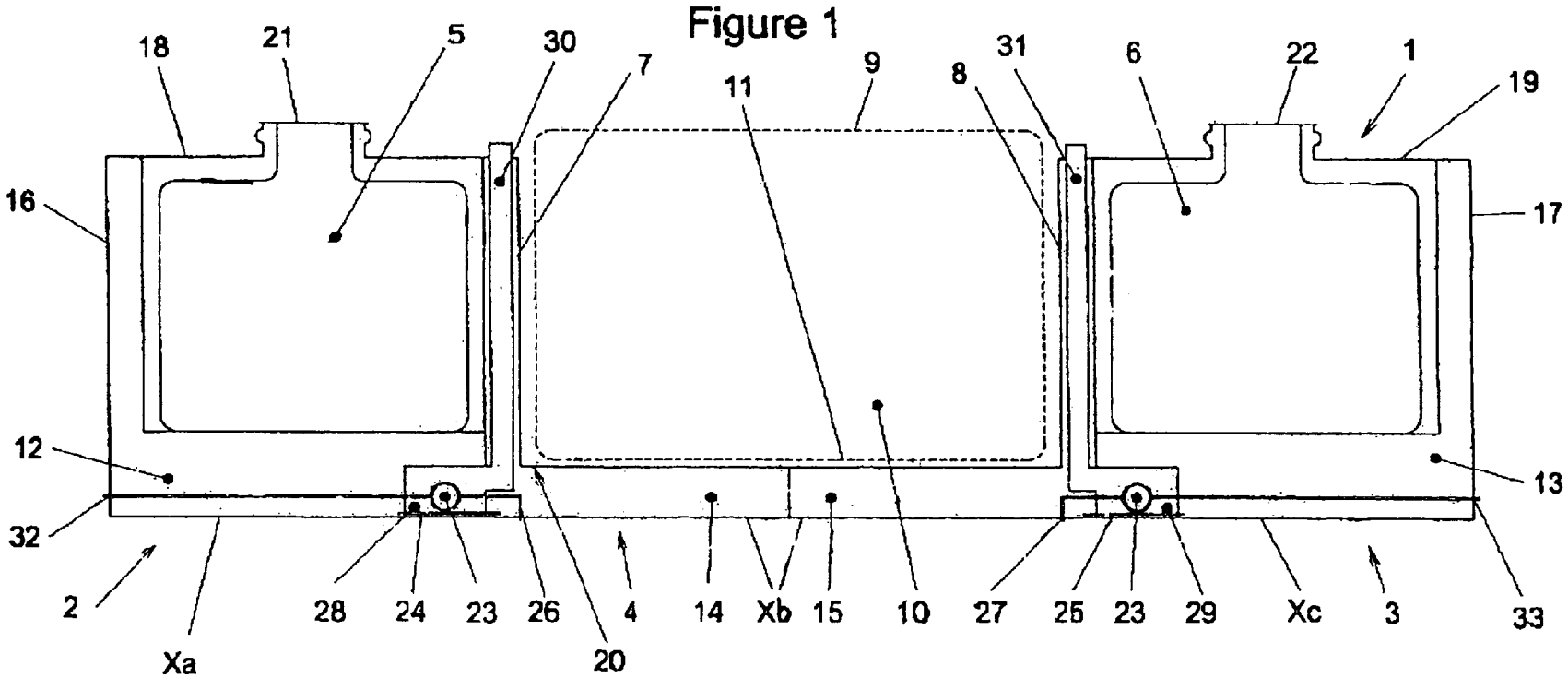
FIG. 1 is a transverse section through an embodiment of a transfer station pontoon according to this invention including a moored vessel.

One embodiment, our presently preferred embodiment, of the invention is more particularly described in connection with the accompanying drawings:

FIG. 1 shows, in transverse section a U-shaped semi-submersible pontoon 1, that comprises a vertically extending port section 2, a vertically extending starboard section 3 and a transverse bottom section 4, which joins sections 2, 3. Pontoon 1 is preferably a single structure with sections 2, 3, 4 permanently joined. Overall dimensions of pontoon 1 are preferably such as to permit drydocking of the pontoon at a conveniently located shipyard. Within port section 2 is at least one LNG storage tank 5. Within starboard section 3 is at least on LNG storage tank 6. Inner wall 7 of port section 2, inner wall 8 of starboard section 3 and upper surface 20 of bottom section 4 form a U-shaped channel that accommodates vessel 10 having a bottom 11. As shown generally in FIG. 1, the height of decks 18, 19 above the top 20 of center section 4 is of the same order as the height of upper deck 9 of vessel 10. Preferably vessel 10 is moored in the transfer station by mooring lines (not shown) extending from deck 9 to decks 18, 19, with fenders (not shown) between the sides of vessel 10 and walls 7, 8 of the U-shaped channel in order to minimize relative motion between the vessel and the transfer station.

Pontoon 1 includes ballast tanks for controlling the depth of its submersion in the water. FIG. 1 shows outboard ballast tank 12 in port section 2, outboard ballast tank 13 in starboard section 3, and two inboard ballast tanks in bottom section 4, namely, port tank 14 and starboard tank 15. At least ballast tanks 12 and 13 must be separate from one another and separately controllable to accommodate varying weights of vessel 10 and different loads on LNG tanks 5, 6. Preferably all ballast tanks are separately controllable to minimize stress on the structure and maximize hydrostatic stability. The depicted embodiment includes one LNG tank and one ballast tank in each of sections 2, 3 and two longitudinally oriented ballast tanks in section 4. In other embodiments a pontoon may include multiple LNG tanks in sections 2, 3, and ballast tanks in sections 2, 3, 4 may be divided either longitudinally or transversely into multiple tanks.

Sections 2, 3 of pontoon 1 include inner walls 7, 8 outer sidewalls 16, 17 and transverse end walls (FIG. 2), forming, with section 4 of pontoon 1, a water-tight containment and support system for LNG tanks 5, 6, ballast tanks 12, 13, 14, 15 and vessel 10, and having a continuous bottom Xa, Xb, Xc for sections 2, 4, and 3, respectively. The preferred embodiment shown in FIG. 1 also includes decks or top walls 18, 19 for sections 2, 3 and deck or top wall 20 for section 4 to prevent water incursion due to wave action or submergence and provide a dry environment for tanks 5, 6. The LNG tanks and their support within sections 2, 3 may be of any suitable design. Tanks 5, 6 preferably are equipped with attached access trunks 21, 22 extending through decks 18, 19 and attached to decks 18, 19 by a flexible watertight joint.

Functionally attached to each of tanks 5, 6 are loading and unloading means 43, 39 and natural gas fill/discharge means 45 (FIG. 2), which pass into tanks 5, 6 through access trunks 21, 22. Means 43, 39 extend downwardly to a point near the bottom of tanks 5, 6. Means 43, 39 and 45 may be of conventional design and include pumps and piping to load and unload the tanks from the top. Ballast tanks 12, 13, 14, 15 include pumping means for loading and unloading the tanks. FIG. 1 shows pumping means. In the preferred embodiment reversible ballast pumps 23 installed near the bottoms Xa, Xc of sections 2,3 and connected to ballast piping 24, 25 may pump ballast water into tanks 12, 13, 14, 15 through a sea connection 26, 27 in bottom section 4 or alternatively discharge ballast water from 12, 13, 14, 15 through said sea connection.

Said reversible ballast pumps and their associated piping and valves required for ballasting and deballasting are preferably installed in separate watertight compartments 28, 29 located within tanks 12, 13 with said watertight compartments in turn connected through decks 18, 19 by watertight trunks 30, 31. Said ballast pumps, piping and valves are preferably of rapid response capability sufficient to minimize structural stress in the U-shaped pontoon by transferring ballast to and from ballast tanks 12, 13, 14, 15 as quickly as LNG is transferred between vessel 10 and LNG storage tanks 5, 6. Said ballast pumps are preferably capable of assisting lateral positioning of the transfer station during entry and departure of the LNG vessel from the transfer station by pumping sea water from either of sea connections 26, 27 and discharging it transversely through piping 32 or 33.

As indicated earlier, the ballasting system optionally may include connection port and starboard ballast tanks for transfer of ballast in opposition to wave action. Design and operation of the various features of the ballast system are similar to the design and operation of ballast systems on oceangoing vessels, and are within the skill of the art.

Figure 4:
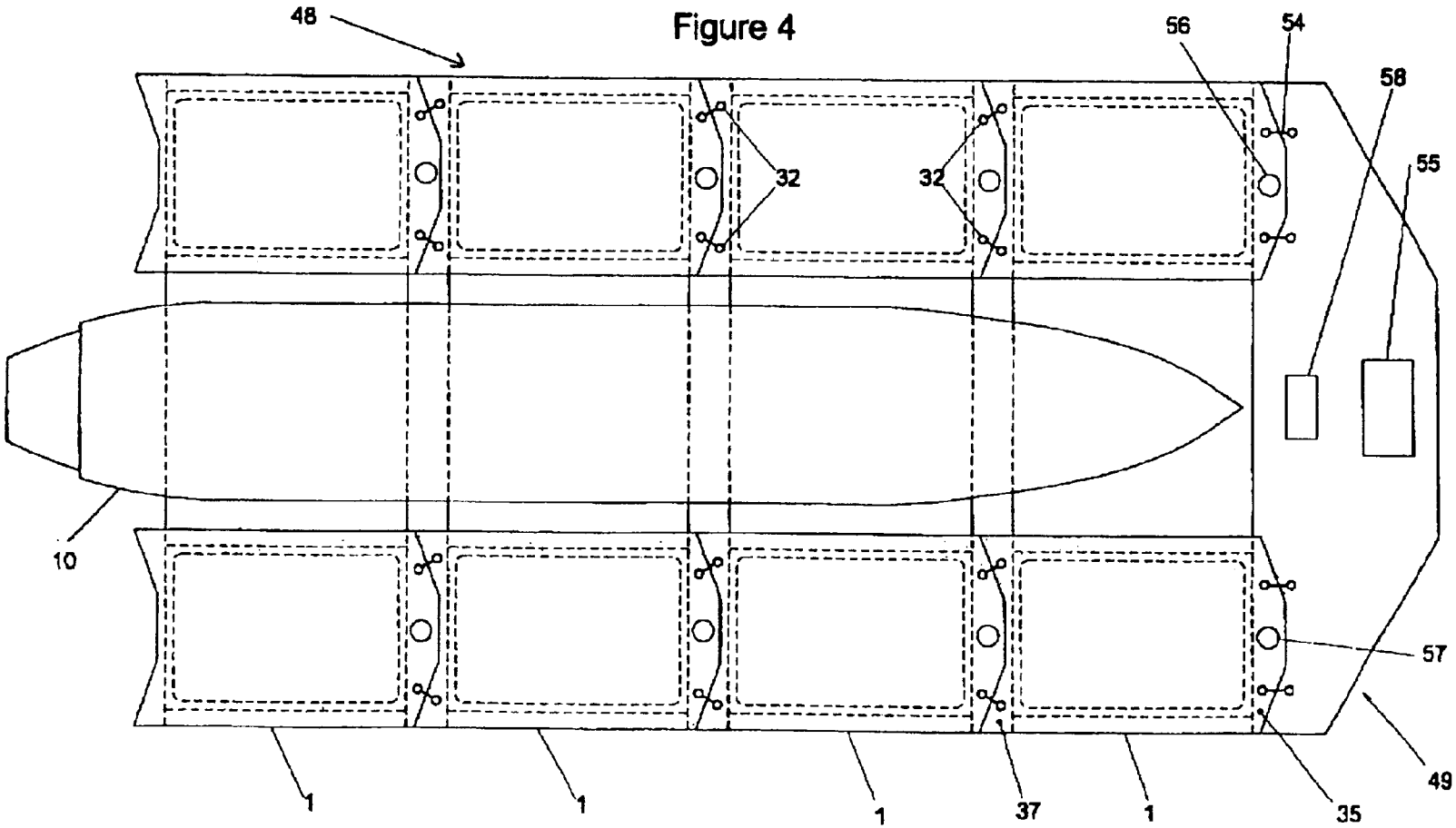
FIG. 4 is a plan view of an embodiment of a transfer station according to this invention having within it a moored LNG vessel.

A preferred embodiment includes a centralized control panel for remotely monitoring the operation of all pumps and valves associated with LNG, natural gas and ballast piping systems. Such a centralized control panel is preferably located at the upper deck level of a bow section, such as panel 58 on bow section 49 (FIG. 4)

In one embodiment, four temporarily interlocked U-shaped pontoons and one interlocked bow section collectively comprise the transfer station. Each U-shaped pontoon 1 has an overall width of 400 feet, width of U-shaped well (distance from wall 7 to wall 8) of 160 feet, extreme depth of sidewalls 16, 17 of 105 feet, depth of U-shaped well of 90 feet and pontoon length of 150 feet not including structural attachments at ends of pontoons needed for temporary interlocking of pontoons. Salt water ballast capacity of each pontoon is approximately 50,000 long tons and LNG tank capacity is approximately 50,000 cubic meters. The U-shaped pontoon of FIG. 1 has a relatively shallow center section 4 joined to and separating sections 2, 3 at or near their bottoms. Central section 4 is a center structural platform intended for the containment of sea water ballast, attached at each end to the bottoms of a deeper side wing structures, sections 2 and 3, which are intended for continuation of water ballast contained in shallow bottom 4 by additional separate spaces 12, 13 of sea water ballast and an insulated LNG tank 5, 6. FIG. 1 also depicts the cross section of an oceangoing LNG vessel 10 as it is anticipated to contact its bottom hull plating 11 with the top steel plating of the center structural plating 20 during transfer of LNG between are oceangoing LNG vessel and the floating transfer station.

Figure 2:
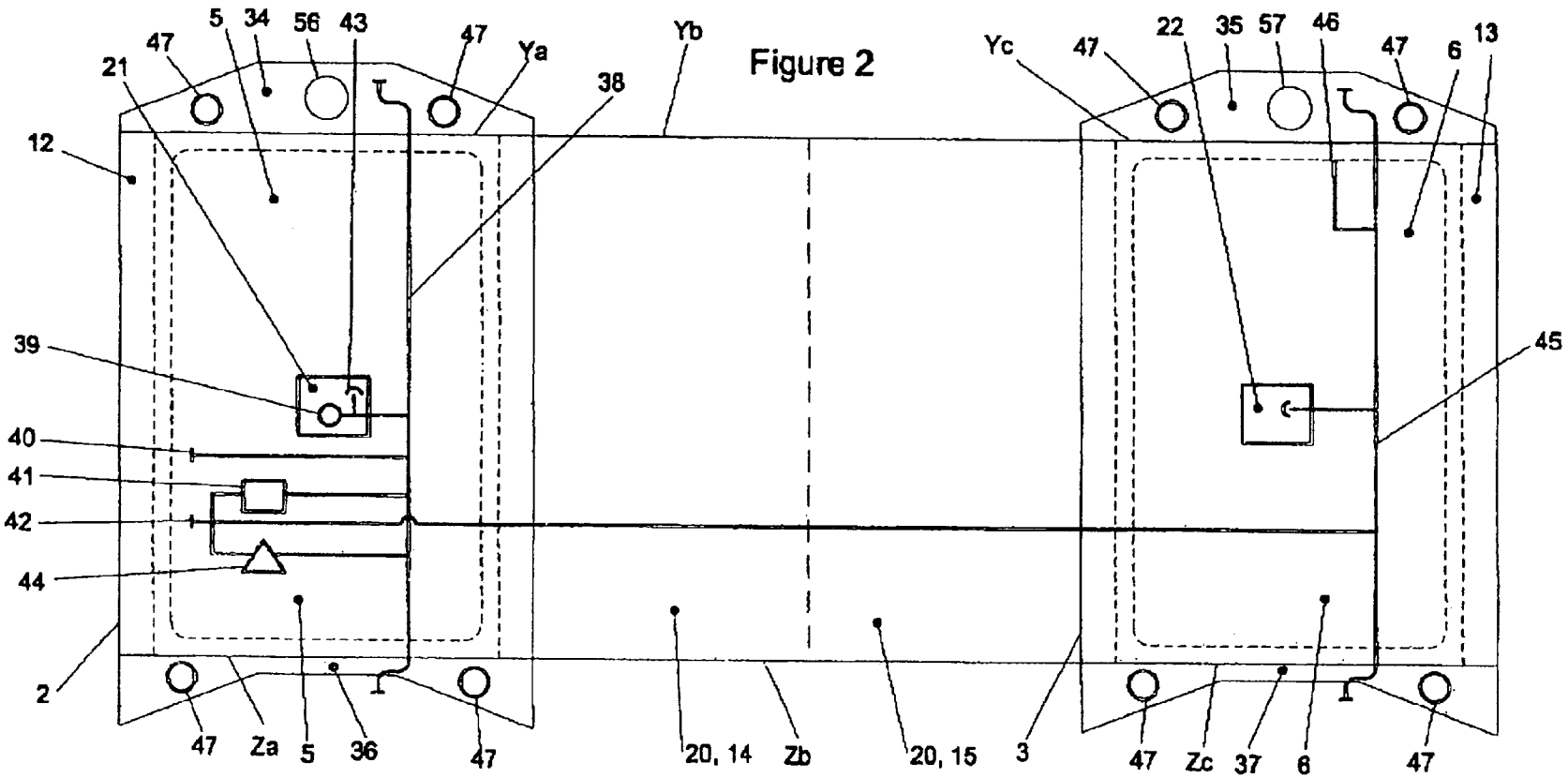
FIG. 2 is a plan view of an embodiment of a transfer station pontoon according to this invention.

FIG. 2 is a plan view of a U-shaped pontoon of FIG. 1. FIG. 2 shows forward vertical walls Ya, Yb, Yc and aft vertical walls Za, Zb, Zc for sections 2, 4 and 3. Ballast tanks 12, 13, 14, 15 are bounded fore and aft by these walls. Forward/aft walls Ya, Za, together with sidewalls 16, 7 form a water-right compartment for LNG tank 5 (FIG. 1), and forward/aft walls Yc, Zc, together with sidewalls 8, 17, for a watertight compartment for LNG tank 6 (FIG. 1). Thus, FIG. 2 shows the longitudinal extent of the ballast tanks 12, 13, 14, 15 and insulated LNG tanks 5, 6 installed within the side wing structures 2, 3, the longitudinal extent of the top 20 of shallow center structural platform 4 and one possible configuration for the structure for reversibly interlocking the U-shaped pontoon to other similar pontoons or to a specially designed bow pontoon. This invention contemplates pontoons that may have flush forward/aft interfaces as well as interlocking forward/aft interfaces. At present we prefer that physical interlocking be utilized, and the interlocking may be either rigid or flexible. Physical interlocking may include a self-centering arrangement to assist in transverse positioning of pontoons relative to one another, particularly if the interlocking system is rigid. The design of an interlocking system is not critical to this invention, and any effective design may be utilized. Numerous possible designs will be apparent to persons skilled in the art. Similarly, this invention contemplates various means to secure adjacent pontoons together as they are brought together to assemble a transfer station. The securing means may be of any effective design, may be rigid or flexible, and may include a quick-connect and/or quick-release feature, if desired. At present we prefer a relatively flexible connection or securing system with a quick-connect/quick-release feature. Numerous possible designs will be apparent to persons skilled in the art.

One possible design of an interlocking design is shown in FIG. 2. This particular design includes a self-centering feature that assists in aligning pontoons as they are pushed together in the ocean. The interlocking feature of the embodiment shown in FIG. 2 comprises forward projections 34, 35 and aft projections 36, 37 of sections 2, 3. Each forward projection is configured to fit into an aft projection of the next forward pontoon and restrain side-to-side motion of the pontoons relative to one another. In planar cross section, forward projections 34, 35, have the shape of truncated triangles, the sloping sides of which assist in centering the pontoon projections within mating aft projections 36, 37 as they are moved into engagement. (This detail is not fully represented in FIG. 2, but should nonetheless be understood as desirably being present.) The matching angled sides of the aft projections assist in centering as well as in preventing side-to-side movement of interlocked pontoons.

Also shown in FIG. 2 are LNG loading/unloading means and natural gas handling means for LNG tanks 5,6. Shown in association with access trunk 21 and tank 5 are LNG transfer means, depicted for illustrative purposes as an LNG filling and discharge line 38; unloading means 39 comprising an LNG pump and pump discharge line for transferring LNG from tank 5 through line 38 either to another pontoon LNG tank, directly to shore piping or to a ship through LNG connection 40, or in the case of installation of regasification equipment on the transfer station to regasification unit 41 and then to shore in the form of a gas through natural gas connection 42. Means 39 may be used reversibly for loading LNG into tank 5 through tank filling connection 43 either from a ship or from shore piping through LNG connection 40, from another pontoon LNG tank, or in the case of installation of liquifaction equipment through gas connection 42 and liquifaction unit 44. Shown in connection with access trunk 22 and LNG tank 6 are gas handling means 45, depicted for illustrative purposes as natural gas fill and discharge line, connected to gas connection 42. Gas line 45 may also be utilized for connection to other pontoon LNG tanks or to a flare pipe tower or towers 46 located on the transfer station. The various means for loading, unloading and transferring LNG and natural gas, and the liquifaction and regasification units can be provided where and to the extent needed for the tasks a particular embodiment of the transfer station is designed to carry out. Connections 40, 42, liquifaction unit 41 and regasification unit 44 are preferably installed on a bow section. A particular station may not need the capability to handle natural gas, and elements 41, 42, 44, 45 and 46 can be eliminated altogether. Further, various piping arrangements can be utilized. For example, whereas FIG. 2 depicts natural gas fill/discharge means 45 to include a pipe running directly from connection 42 to tank 6 for illustrative purposes, an attractive routing would rather be through a bow section to cross from section 2 to section 3.

FIG. 2 also shows securing means 47 mounted fore and aft on each section 2, 3 for reversibly securing interlocked pontoons in place. Securing means 47 can be as simple as wire rope or they can include a more rigid connection. They can be operable by hand or remotely operable from a control panel 58 (FIG. 4), shown conveniently situated on deck 51 of the bow section.

Figure 3:
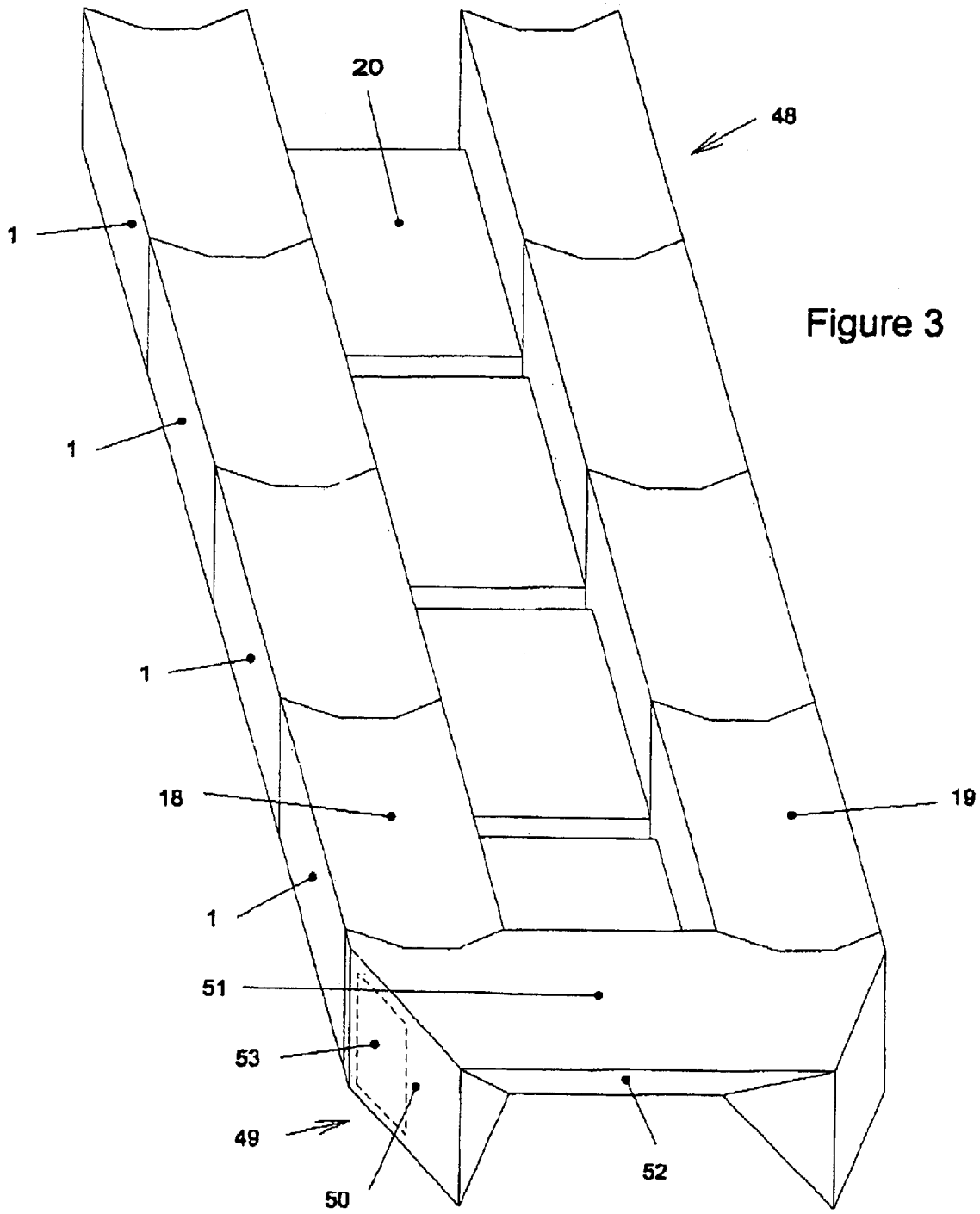
FIG. 3 is a perspective view of an embodiment of an embodiment of a transfer station according to this invention.

FIG. 3 is a simplified perspective of four U-shaped pontoons 1 and one bow section 49 interlocked to create an LNG floating transfer station 48 contemplated by the invention. Bow section 49 contributes stability to the structure in the sea, and may have water lines of any conventional bow design. In the depicted embodiment, bow section 49 includes inwardly angled vertical sides 50, deck 51 and upwardly sloping front wall 52. By including ballast tanks 53 in the port and starboard areas of bow section 49, bow deck 51 can be maintained at the same level as port and starboard decks 18, 19 of forwardmost pontoon 1. Bow section 49 can be a separate section, as shown, or an integral bow section can be included in the forwardmost pontoon. For some applications a station-wide bow section need not be included.

FIG. 4 is a plan view of the floating LNG transfer station 48 described in FIG. 3 depicting an oceangoing LNG vessel 10 installed in the U-shaped well of the transfer station during LNG transfer between LNG vessel 10 and transfer station 48, and also depicting an anchoring connection for the transfer station from its bow to the ocean bottom. FIG. 4 again shows four pontoons 1 interlocked to each other and separate bow section 49 by means of forward projections, for example 35, and cooperating aft projections, for example 37. The interlocked sections are secured in the fore-aft direction by securing means 54, here depicted schematically in their engaged positions. Bow section 49 includes anchoring connection 55, which in turn is connected by wire rope, chain or a combination thereof to an anchoring connection firmly fixed to the ocean bottom. Alternately, pontoon forward projections 34, 35 may be equipped with vertically oriented chain pipes and main deck mounted chain securing devices 56, 57 and secured thereto with a third section of chain yoke secured to an anchoring connection fixed to the ocean bottom. In this way the single point mooring device may comprise two ends of a chain yoke drawn through pipes 56, 57 and secured thereto with the third section of chain yoke.

A number of embodiments of the invention have been described. Nevertheless, it will be understood that various modifications may be made without departing from the spirit and scope of the invention. Accordingly, other embodiments are within the scope of the following claims.

What is claimed is:

1. A semi-submersible floating transfer station suitable for transferring liquid natural gas (LNG) to or from an oceangoing vessel, comprising at least one semi-submersible pontoon, said at least one pontoon including a port section and a starboard section each having at least one outboard ballast tank below a decked, watertight compartment housing at least one LNG tank, LNG transfer means comprising a first pump and associated piping for transferring LNG to and from said vessel, said LNG tanks and shore-transfer piping, a depressed central section attached to and separating said port and starboard sections at their bottoms, said central section including at least two inboard ballast tanks, said port, starboard and central sections forming a U-shaped channel into which said vessel may be placed for loading or unloading, and a ballast-deballast system capable of adjusting the submergence in the water of said central section to conform to the draft of said vessel during loading or unloading and maintaining said pontoon in a horizontal attitude, and anchoring means for mooring said floating transfer station at a desired location.

2. The transfer station according to claim 1 comprising at least three pontoons, pontoons further comprising means to reversibly secure said pontoons to one another with their U-shaped channels aligned to accommodate said vessel.

3. The transfer station according to claim 2 wherein said pontoons further include matable fore/aft projections to interlock said pontoons.

4. The transfer station according to claim 3 wherein said interlocking means includes self-centering means to align said pontoons when they are pushed together.

5. The transfer station according to claim 2, wherein one of said pontoons includes an enclosed bow projection extending forwardly from said U-Shaped channel, said bow projection closing one end of said channel.

6. The transfer station according to claim 2 further comprising a separate semi-submersible decked bow section engagable with one of said pontoons so as to close one end of said channel, said bow section including ballast tanks and ballast-deballast means for adjusting the height of the bow-section deck to the height of the deck of the adjacent pontoon.

7. The transfer station according to claim 2 further comprising a regasification unit for receiving LNG from said vessel or said LNG tanks, gasifying it, and transferring it to shore piping.

8. The transfer station according to claim 2 further comprising a liquifaction unit for receiving natural gas from a shore line, liquefying it to LNG, and transferring said LNG to said vessel or to said LNG tanks.

9. The transfer station according to claim 2 wherein at least one pontoon can be disengaged, placed in the aligned U-shaped channel formed by remaining pontoons, and raised clear of the water for maintenance and repair.

* * * * *